United States Patent [19]

Ward, Sr.

[11] 4,276,945

[45] Jul. 7, 1981

[54] MUD RETURN LINE CONNECTOR APPARATUS

[76] Inventor: Bobby N. Ward, Sr., 11607 Primwood Dr., Houston, Tex. 77070

[21] Appl. No.: 46,829

[22] Filed: Jun. 8, 1979

[51] Int. Cl.[3] ..... E21B 17/02; E21B 21/06; F16J 15/46; F16L 17/00

[52] U.S. Cl. ..... 175/209; 277/34.3; 285/97

[58] Field of Search ..... 175/207, 209, 214; 285/97; 277/34.3

[56] References Cited

U.S. PATENT DOCUMENTS

| | | | |
|---|---|---|---|
| 2,198,510 | 4/1940 | Carey | 141/9 |
| 2,244,939 | 6/1941 | Carlson | 285/2 |
| 2,605,083 | 7/1952 | Collins | 175/206 |
| 2,814,514 | 11/1957 | Beatty | 285/97 X |
| 3,023,995 | 3/1962 | Hopkins | 285/97 X |
| 3,355,188 | 11/1967 | Knickelmann et al. | 285/13 |
| 3,501,059 | 3/1970 | Van Der Lely | 222/176 |
| 3,722,556 | 3/1973 | Jeffers et al. | 285/97 X |
| 3,722,587 | 3/1973 | Diaz | 166/88 |
| 3,810,665 | 5/1974 | Rodgers | 285/97 |
| 4,109,922 | 8/1978 | Martin | 277/34.3 |

*Primary Examiner*—Stephen J. Novosad
*Attorney, Agent, or Firm*—Gunn, Lee & Jackson

[57] ABSTRACT

The preferred and illustrated embodiment is a connector adapted to be joined above a blowout preventer and below the rotary table of a drilling rig. It collects the annular flow of returned drilling mud and directs mud to an incorporated, radially directed connective nipple. It enables the blowout preventer to be adjusted in location relative to the drilling rig and further accommodates a variable level of drilling mud in the annular space. The radial nipple connects with a mud line extending at some radial direction with a slope causing the mud to flow by gravity from the annular space to remote located mud tanks.

10 Claims, 4 Drawing Figures

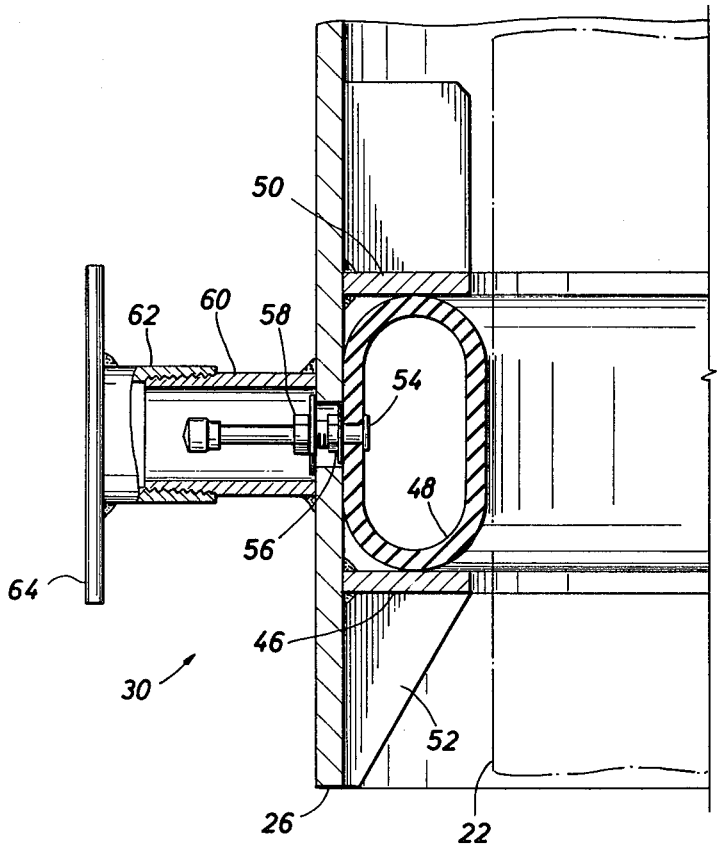
FIG. 3
FIG. 4
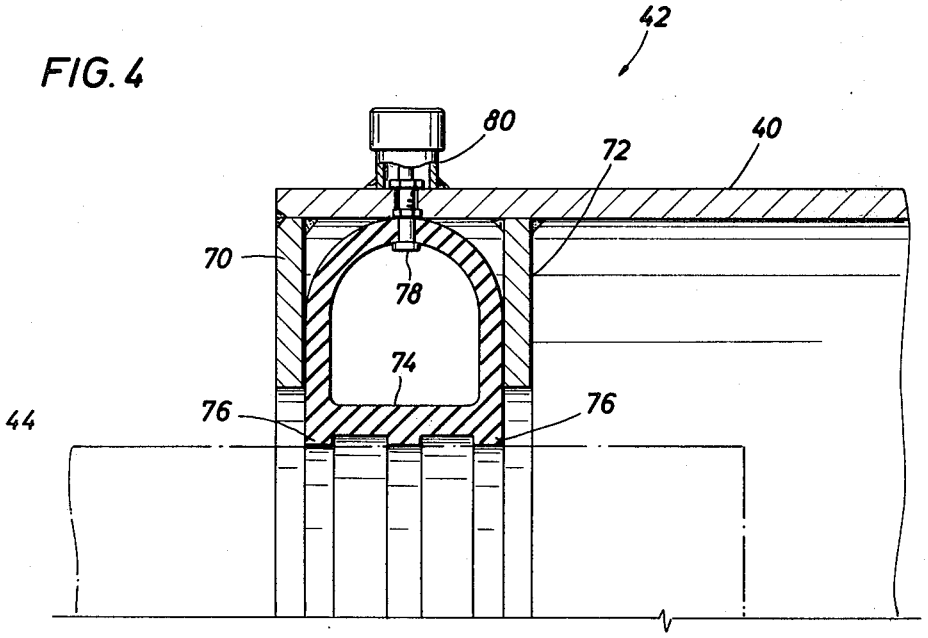

MUD RETURN LINE CONNECTOR APPARATUS

BACKGROUND OF THE DISCLOSURE

In drilling an oil well, it is first necessary to situate a blowout preventer and drilling rig structure before drilling can begin. Blowout preventers and drilling rigs vary in size and configuration. The framework which supports a drilling rig is varied in configuration so that access to the underside, while always available, is different from job to job. This difference is sometimes accentuated by customer requirements as, for example, specified casing connections which modify the elevation of the blowout preventer relative to the drilling rig. The blowout preventer may stand tall in one installation; the same equipment used for another customer will be configured differently as a result of terrain and customer requirements. Variations in terrain and working area also modify the location of the mud tanks. They may be arranged at any relative angular direction from the drilled hole. As will be understood, the mud flows through the drill string and returns up the annulus to be returned to the mud pits. It is necessary to construct a mud return line from the cased hole to the pits.

In the past, the problem of erecting the drilling rig and all the associated equipment has been handled on an ad hoc basis. This has required the services of welders and pipe fitters at the site. They typically position the major structural members such as the drilling rig with its supporting framework therebeneath and also position the blowout preventer in the manner and position specified by the customer. Thereafter, through the use of support chains, spare frame members, surplus pipe and the like, a funnel is typically welded in position to handle the annular upflow of drilling mud. The funnel is typically cut, and a nipple is attached. The nipple is then connected by welding or custom fittings to some kind of lateral mud line which drains into the mud tanks. The mud flow line typically must weave and snake its way through the framework beneath the drilling rig.

The mode of construction described above is tedious and typically delays installation of the drilling rig preparatory to drilling operations. The delays are costly, not only in labor of the welding personnel, but they are costly in that rig rental time is expensive.

BRIEF SUMMARY OF THE DISCLOSURE

One of the features of the present invention is that the equipment can be installed without the services of a welder. It is versatile, thereby enabling the present invention to be installed at the desired connection beneath drilling rig with all mud lines in position and quickly connected. Moreover, the present apparatus incorporates an advantageous seal structure which is quickly installed and made leakproof to avoid leaking mud beneath the drilling rig. Accordingly, this apparatus has the advantageous of expediting drilling rig setup time. The drilling rig is erected, and drilling begins more rapidly, and drilling costs are thereby reduced. Moreover, the equipment can be installed through the use of laborers and cuts down on requirements of expensive skilled labor.

One advantage of the present invention is that it furnishes standardized equipment. By standardization, one gain is the reduction of welding. Through standardization, workmen become familiar with the mode of installation and removal and become more efficient. Through standardization, variations in rig size and deployment are accommodated through that portion of the standardized equipment which moves or adjusts. This enables the standardized equipment to be installed under rigs of many sizes and types of manufacture.

With the background in mind, the present apparatus is summarized as a first tubular member having a bottom located flange which enables it to be connected to the top outlet of a blowout preventer. This connects with the annulus of a well being drilled and enables the mud to flow up through the first tubular member which serves as a fixed member and thereby guides a surrounding funnel-shaped member. The two are connected together by an expandable or inflatable seal. The second member serves somewhat as a funnel or catch basin, it being taller and larger in diameter. It is positioned at the desired location and level to support an outwardly extending, radial nipple. The nipple is aligned at a desired radial direction and height relative to the mud tanks to enable a segmented, adjustable connector and mud line to be joined from the radial nipple to the mud tanks. The installation is quickly achieved by using air inflatable seals on the nipple and between the first and second tubular members.

BRIEF DESCRIPTION OF THE DRAWINGS

FIG. 3 is an enlarged, partial, sectional view showing details of construction of an inflatable seal means used in the apparatus; and FIG. 4 is an enlarged, sectional view of the seal means for securing a telescoping mud flow line to the nipple.

DETAILED DESCRIPTION OF THE ILLUSTRATED EMBODIMENT

Figure 1:
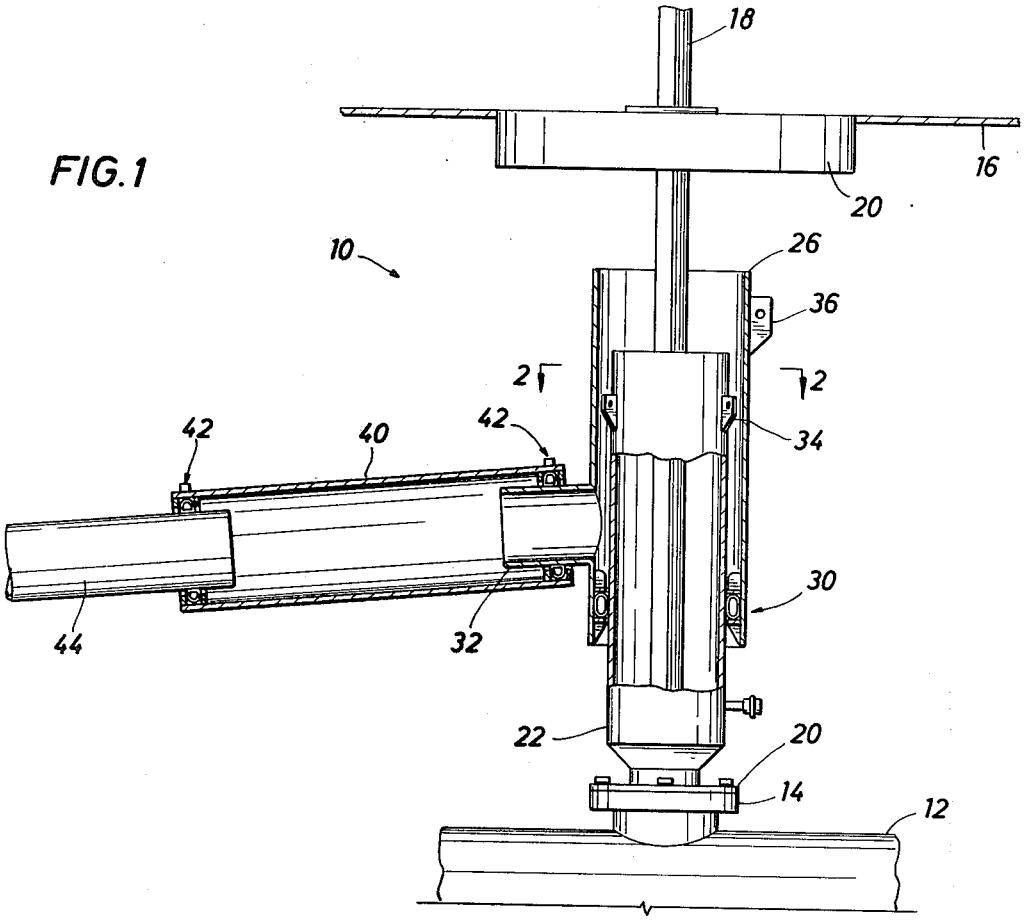
FIG. 1 shows the connector of the present disclosure installed in a drilling rig with portions shown in sectional view to illustrate internal details of construction.
Figure 2:
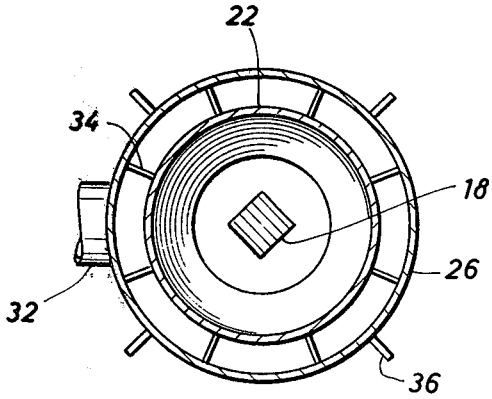
FIG. 2 is a sectional view along the line 2—2 of FIG. 1 showing internal details of construction.

Attention is first directed to FIG. 1 of the drawings, where the connector of the present invention is identified by the numeral 10. It is shown installed with certain support equipment which will be described first to give the context of its application. The numeral 12 identifies the top portions of a blowout preventer equipped with a flange 14 which surrounds the drill pipe. It includes rams which are pinched together to close off the well in the event of a blowout. It provides two paths, one downwardly through the drill string where the mud flows to the drill bit to lubricate the drill bit. The second flow path is in the annular cavity around the drill string where mud flows upwardly. Mud flows upwardly and out through the flange plate 14, which is the point of connection of the connector 10 of this disclosure.

The numeral 16 identifies a rig floor. The rig is supported by a number of frame members including beams, girders and the like. These are constructed below the rig floor 16 to hold the rig at a specified elevation. The distance or space between the blowout preventer 12 and the rig floor 16 may vary widely. As it varies, the distance variations constrain the position, height and variations of placement of the connectors which have been used heretofore. Such constraints are accommodated by the structure shown in this disclosure. The rig floor is part of the drilling rig proper. The drilling rig includes an overhead derrick which suspends drilling equipment. The derrick suspends, among other things, a square, hollow pipe which is known as a kelly identified at 18 in FIG. 1. The kelly is rotated by a driven, central member keyed to fit around the kelly. The driving member is part of a rotary table 20 supported on the rig floor. The rotary table rotates, thereby imparting rotation to the kelly which, in turn, rotates the drill pipe. The kelly extends downwardly and connects by a threaded connection to the drill string.

The working space and height limitations resulting from the positioning of the blowout preventer 12 at a specified location beneath the rig floor 16 must always be accommodated. The present apparatus is able to accommodate this. To this end, this disclosure utilizes first and second major upstanding, cylindrical members to handle drilling mud. The numeral 20 identifies a flange which matches the flange 14, there being a set of nuts and bolts enabling the two flanges to be joined together. This directs mud on upward flow into a first cylindrical member 22. The cylindrical member 22 has an internal, cylindrical volume which is larger in diameter than a selected large drill bit. It is sized to enable the drill string to pass through it and to return a specified rate of mud flow. The cylindrical member 22 is an upstanding, open-ended cylinder having a bottom, tapered portion which connects with the flange plate 20. It is hollow to enable the drill string to extend through it and to rotate as the well is drilled. The cylindrical member 22 has exemplary dimensions in the range of 10.0 to 20.0 inches in internal diameter and stands as tall as perhaps 4.0 or 5.0 feet. It is made of fairly heavy walled metal such as quarter-inch stock or the like and stands open at the upper end.

The first tubular member 22 receives an up flow of drilling mud which overflows the top end. It spills out and fills a second tubular member 26. The tubular member 26 is larger in diameter than the first tubular member, enabling the two to telescope together so that the net height of the top end of the second tubular member is variable. The second tubular member 22 is raised and lowered to adjust its height. A seal means generally identified at 30 seals the lower end of the tubular member 26 around the smaller tubular member 22. This seal is sufficiently leakproof to prevent the escape of drilling mud past the seal. The seal will be described in detail when FIG. 3 is described.

The seal means 30 can be positioned at any relative height on the first tubular member 22. Variations in height elongate the structure so that different quantities of mud can be momentarily stored in it. This is necessary to raise the level of mud so that it is able to thereafter flow downhill toward the mud tanks. The second tubular member 26 is equipped with a laterally directed nipple 32 of substantial diameter, typically in the range of 10.0 inches or more. It has significant length, perhaps up to 24.0 inches. The length is sufficient to enable connection to be made to the nipple 32. The nipple is located in the lower half of the outer cylindrical member so that mud flows away from it by gravity flow. The nipple 32 slopes slightly downwardly as shown in FIG. 1. This initiates gravity flow to the mud pits at a remote location.

The first cylindrical member includes a set of chain hoist lugs 34 included for the convenience of the installer in hoisting the equipment and positioning it. In addition, similar lugs 36 are fitted on the outside of the outer tubular member and also enable connection to the underpinnings of the platform, a means for fastening and anchoring the apparatus at a particular location. They can be used for hoisting and anchoring. The first and second tubular members weigh hundreds of pounds in a typical installation as a result of their height and diameter. To this end, the lugs are provided for lifting.

The sloping outlet nipple 32 is fluidly connected to a telescoping pipe 40 including a seal means 42 which fits around the nipple 32. The seal means 42 will be discussed in greater detail with reference to FIG. 4 of the drawings. The telescoping pipe 40 slides up over the nipple 32 to a location enabling it to connect with a mud pipe 44. The seal means 42 is duplicated at the opposite end.

The mud pipe 44 has a length which extends away from FIG. 1 to a mud tank. As viewed from overhead, the mud tank is at some radial angle relative to the rotary table, and the connective nipple 32 and the coupling 40 are joined together to complete the mud flow path. The mud flow path is in large part a matter of happenstance in the deployment of the understructure of the rig, the blowout preventer and the mud tanks. The mud pipe may be short or long, as the case may be. In any event, mud flows along it by gravity feed. The gravity flow path begins as the mud spills over the top end of the inner tubular member 22 and is then directed outwardly through the nipple 32.

The seal means 30 is illustrated in greater detail in FIG. 3, where it will be observed that the inner tubular member 22 is positioned on the interior of the seal means. The seal means is constructed by placing a radially, inwardly directed ring 46 around the interior of the outer tubular member 26. The ring 46 is immediately adjacent to a hollow, rubber diaphragm having the form of a doughnut. It is hollow on the interior and shaped into a ring. It is equipped with a thick wall and is preferably made of a material which is able to flex and resist abrasion. It is captured above the internal ring 46 and below an upper ring 50. The rings 46 and 50 are parallel to one another and are parallel to define a cavity which encloses the inflatable seal 48. The seal 48 is thus received in a constrained structure between the plates 46 and 50 and is on the interior of the surrounding, tubular member. This constrains the inflatable seal 48 when it expands. It is made of a resilient material and adapted to receive inflation through means to be described and will enlarge by flexing radially inwardly. This brings it snugly into contact with the tubular member 22, and such contact seals against the escape of mud between the two tubular members. It will be observed that the rings 46 and 50 are periodically reinforced by gussets 52 to impart strength.

The inflatable seal 48 includes a stem 54 which is a hollow member having threads on the exterior. The stem terminates at an enlarged lip, and the lip is on the interior of the seal. Through the use of a nut and large washer at 56, the stem is clamped at a hole in the inflatable seal 48. The stem is then fixed in position through the use of a large washer and nut at 58 which clamps the seal 48 and the stem to the outer tubular housing 26. Clamping action secures the stem at a fixed location. Protection for the stem is obtained by welding a stand pipe 60 around it. The stand pipe is closed by a threaded cap 62. A handle 64 is conveniently attached to the cap.

In operation, the seal 48 is made operative by inflating the inflatable seal 48, achieved by utilizing a source of compressed air which is connected to the stem 54, and air is delivered to the seal until it expands. It eventually expands to a size which causes radial, inward deflection against the confining, inner tubular member 22, thereby sealing against it. A wide surface area contacts against the surface, and the seal is perfected at the surface area.

In FIG. 4 of the drawings, the connector pipe 40 which includes the seal 42 is illustrated. The seal means 42 is somewhat similar in construction to the seal means 30. It is arranged on the interior of a large tubular member to clamp in a sealing manner against a smaller, telescopically positioned, tubular member. The connector 40 includes a pair of identical, radially, inwardly directed rings 70 and 72. The two rings are parallel and spaced from one another and define an internal receptacle to receive an inflatable seal 74. The seal 74 is made of a resilient material and is abrasion resistant. The seal is formed of a resilient material shaped in the form of a hollow doughnut. The inflatable seal 74 has ribs on its inner face at 76 which are spaced from one another and extend fully around the inner face of the inflatable seal. The inflatable seal 74 is provided with a valve stem 78 similar to the valve stem illustrated in FIG. 3. It is received in a protective stand pipe 80 similar to the stand pipe 60 previously described. The operation of the seal means 42 is achieved in the same manner as the seal 30 shown in FIG. 3.

Operation of the present invention proceeds in the following manner. At the time of erection of a drilling rig at a selected drilling site, the blowout preventer and rig structure are deployed. Dependent on regulations typically imposed by the contracting parties, the blowout preventer will be installed at a specified location relative to the well to be drilled, and the spacing between the top of the blowout preventer and the rig floor may vary. While these circumstances vary, they pose dimensional limitations which are hard to predict. The present apparatus is installed at the top of the blowout preventer by bolting it to the flange plate 14. Once installed, the inner tubular member 22 stands upright, open at the top, and is located so that the drill string and kelly 18 pass through it. It may be necessary because of the weight of the apparatus to temporarily support it on the hoist lugs 34 on the exterior. After it has been positioned in the upright position and bolted at the lower end, the outer tubular member 26 is then moved vertically and rotationally. It is moved vertically so that the outlet nipple 32 is raised above the mud tanks so that gravity flow to the mud tanks may occur. It is also raised to a height selected to route the mud line 44 through the underpinnings of the rig structure. This may require telescoping movement, but the present invention is more than able to accommodate such movement. The outer tubular member 26 is thus raised to an elevation to position the outlet nipple 32 at the desired location. Because it is quite heavy, it may be wise to utilize the hoist lugs 36 and suitable cables or chains to tie it to the underpinnings of the rig structure to support it at the desired position.

After the first and second tubular members have been appropriately positioned, compressed air is applied to the seal 30, and the seal is perfected. Thereafter, drilling mud cannot escape through the gap adjacent to the seal means 30. In addition, the mud pipe 44 is routed through the underpinnings of the structure and brought close to the nipple 32. The pipe coupling 40 is telescoped over the end of the mud pipe 44. It is then aligned with the nipple 32. It may be necessary to accommodate slight angular misalignment at the two ends of the coupling 40. No particular problem arises so long as the misalignment is a matter of a few degrees. The coupling 40 is positioned over the end of the mud pipe 44 and about the nipple 32. Thereafter, the seals at each end, better shown in FIG. 4, are inflated by applying compressed air. They complete a seal which does not leak mud.

The apparatus can then be left to operate for an indefinite interval. During its use, mud flows upwardly from the well and overflows the top end of the member 22. It fills the outer tubular member above the seal means 30. As the level rises, it flows out through the nipple 32. Mud flows downhill by gravity flow through the pipe coupling 40 and the mud pipe 44. It will be appreciated that flow rates as much as 1,000 gallons per minute might well occur. Flow rates of this size are accommodated by the present invention.

When the drilling operation has been finished, the apparatus of the present invention can be readily disassembled by deflating the seals. When they are deflated, it permits disconnection of the mud line 44. The apparatus is readily retrieved by unbolting from the blowout preventer 12 and can thereafter be installed elsewhere. The speed of installation is a significant virtue in the present apparatus. Moreover, installation is achieved without welding and does not require metal cutting. It is versatile in that variations in height and azimuth are easily permitted. Slight misalignment also assists in installation in instances where the coupling 40 accommodates canted arrangements of the mud pipe 44. As is shown, the coupling 40 also accommodates variations in length.

While the foregoing is directed to the preferred embodiment, the scope is determined by the claims which follow.

I claim:

1. For use above a well during drilling and below the rig floor of a drilling rig which drills the well, wherein the well is drilled with drilling mud which flows back toward the surface where the rig is installed and the mud flow is upwardly through the well, mud handling apparatus which connects with the mud handling equipment therebelow and which comprises:

(a) a first, upright tubular member having an open lower end which open lower end permits the drill string to pass therethrough and which additionally permits mud to flow upwardly thereinto, said first tubular member having an open upper end and which is further adapted to be filled to overflowing with drilling mud;

(b) a second, larger tubular member positioned about the first tubular member and defining a surrounding annular, mud receiving space about said first tubular member permitting mud to overflow into the annular space;

(c) means for sealing said second tubular member to said first tubular member to prevent the escape of mud from the annular space therebetween; and (d) an outlet nipple means extending from the mud receiving annular space and adapted to deliver an outwardly directed flow of mud from the mud receiving annular space.

2. The apparatus of claim 1 wherein said first and second tubular members are concentric, upright cylinders open at the upper ends thereof, and said seal means is an encircling, concentrically deployed seal means having a hollow interior to receive pressure fluid therein for inflation thereof and is formed of resilient material to inflate and thereby seal.

3. The apparatus of claim 2 wherein said first tubular member incorporates a bottom located connective means for releasable joinder to the well, and further including hoisting lugs positioned and located for lifting said first and second tubular members.

4. The apparatus of claim 1 including a telescoping pipe connector means releasably connected to said nipple means and slidably positioned relative thereto to enable adjustable connection with a laterally directed mud line extending toward a mud pit.

5. The apparatus of claim 4 including pressure fluid inflatable and releasable seal means at spaced locations in said connector means, one of said seal means adapted to sealingly engage said nipple means and the other of said seal means being adapted to releasably engage a mud pipe positioned therein.

6. The apparatus of claim 1 wherein said sealing means comprises:

(a) first and second encircling, spaced rings surrounding said first tubular member, said rings defining an encircling cavity open along the inner side wherein said rings are supported on said second tubular member; and (b) an inflatable, resilient seal having a face portion adjacent to said first tubular member and which seal is selectively inflatable to radially, selectively contact said first tubular member to form a seal thereagainst.

7. The apparatus of claim 6 wherein said rings are joined to said second tubular member.

8. For use above a well during drilling and below the rig floor of a drilling rig which drills the well, wherein the well is drilled with drilling mud which flows back toward the surface where the rig is installed and the mud flow is upwardly through the well, mud handling apparatus which connects with the mud handling equipment therebelow and which comprises:

(a) a detachable, upstanding, mud receiving means having a mud receiving space therein;

(b) an outlet nipple means extending from the mud receiving space and adapted to deliver an outwardly directed flow of mud from the mud receiving space;

(c) a laterally extending mud flow line adapted to deliver a flow of mud to a mud pit; and (d) telescoping elongate connector means sealingly connecting said mud line and nipple means to define a mud flow path to the mud pits of adjustable length.

9. The apparatus of claim 8 wherein said connector means comprises an elongate, hollow, tubular body having first and second seal means, respectively, at opposite ends thereof and including means for selectively joining said seal means to said nipple means and the mud line.

10. The apparatus of claim 9 including first and second inflatable seal rings selectively inflatable to contact against said hollow tubular body and seal thereagainst.

* * * * *